US005762096A

United States Patent [19]

Mirabile

[11] Patent Number: 5,762,096

[45] Date of Patent: Jun. 9, 1998

[54] COMPUTER CONTROLLED PORTABLE GRAVITY FLOW CONDUIT CLEANER

[75] Inventor: Paul J. Mirabile, Plymouth Meeting, Pa.

[73] Assignee: PNM, Inc., Plymouth Meeting, Pa.

[21] Appl. No.: 799,773

[22] Filed: Feb. 12, 1997

[51] Int. Cl.[6] ..... B08B 3/04; B08B 9/06

[52] U.S. Cl. ..... 137/240; 134/57 R; 134/58 R; 134/98.1; 134/100.1; 134/168 C; 134/169 C; 137/597; 137/624.13; 222/148

[58] Field of Search ..... 134/166 R, 169 R, 134/168 C, 169 A, 169 C, 57 R, 58 R, 95.1, 98.1, 99.1, 99.2, 100.1; 137/240, 597, 624.11, 624.12, 624.13; 141/89, 98, 92

[56] References Cited

U.S. PATENT DOCUMENTS

| | | | |
|---|---|---|---|
| 1,896,004 | 1/1933 | Lewis et al. | 134/98.1 |
| 2,030,398 | 2/1936 | Rivard et al. | 134/98.1 |
| 2,098,525 | 11/1937 | Smith | 134/98.1 |
| 2,183,007 | 12/1939 | Buchhorn | 134/98.1 |
| 3,025,863 | 3/1962 | Eberle | 134/98.1 |
| 3,094,131 | 6/1963 | Williams | 134/98.1 |
| 3,441,034 | 4/1969 | Burks | 134/100.1 |
| 3,945,536 | 3/1976 | Doak | 222/148 |
| 4,276,914 | 7/1981 | Albertson | 134/169 A |
| 4,527,525 | 7/1985 | Mirabile | 137/240 |
| 4,582,226 | 4/1986 | Doak | 222/148 |
| 4,597,416 | 7/1986 | Scales | 134/169 A |
| 4,606,311 | 8/1986 | Reyes et al. | 134/169 A |
| 4,606,476 | 8/1986 | Pocock et al. | 134/169 R |
| 4,848,381 | 7/1989 | Livingston et al. | 134/169 R |
| 4,877,043 | 10/1989 | Carmichael et al. | 134/57 R |
| 4,911,832 | 3/1990 | Miller | 134/169 R |
| 4,941,596 | 7/1990 | Marty | 222/148 |
| 4,991,608 | 2/1991 | Schweiger | 134/169 A |
| 5,090,440 | 2/1992 | Ladouceur et al. | 137/240 |
| 5,601,127 | 2/1997 | Hanson | 134/169 R |

*Primary Examiner*—George L. Walton
*Attorney, Agent, or Firm*—Eckert Seamans Cherin & Mellott

[57] ABSTRACT

A portable cleaning and flushing device for beverage conduits such as draft beer distribution coils includes a manifold, couplings and a number of valves which are controllable so as to sequence the supply of detergent from a reservoir, mixing with water from an external water source and flushing and rinsing of the distribution conduits. The device is wheeled about like a handcart and is coupleable to one or more beverage distribution lines by lead lines in place of normally attached kegs. The device is coupled to a water supply and to an electric power outlet. Detergent and pressurized water are mixed and flushed through the beverage conduit to an open spigot at the dispensing end. A preferably programmable computerized controller sequences the operation of valves for detergent addition to a manifold, venting of the manifold, water supply for obtaining a mixing solution, application of the mixing solution to the conduit, rinsing and finally draining. The controller accepts user input for triggering operation and preferably also for defining customized parameters for particular beverage delivery systems and user choices.

15 Claims, 4 Drawing Sheets

COMPUTER CONTROLLED PORTABLE GRAVITY FLOW CONDUIT CLEANER

BACKGROUND OF THE INVENTION

This invention relates to conduit cleaning devices for beverage delivery systems. A self contained computer controlled conduit cleaning device is coupleable to a beverage delivery system for performing a series of operations whereby a sanitizing agent and pressurized water are applied to flush and clean beverage conduits.

A beverage delivery system generally comprises a source of a beverage, for example one or more beer kegs, a source of pressure, for example a container of compressed carbon dioxide coupled to the kegs, and conduits or flow lines as needed to carry the beverage from the keg(s) to a dispensing point, typically having a manually activated tap or spigot.

In order to cool the beverage to an appropriate temperature for drinking, the beverage source can be stored in a refrigerated area such that the entire supply is kept cool. Alternatively, conduits between the source and the dispensing point can be passed through a cooling device or a refrigerated space, for cooling the beverage to the desired temperature just prior to dispensing. Taverns advantageously have a refrigerated room for cold storage of beer kegs and the like. Permanently-installed plumbing conduits are provided, running between the refrigerated room and the dispensing spigots at a bar or similar customer area. The kegs and the pressurized gas are attached to the conduits by connecting lines in the refrigerated room.

Draft beer from a keg is remarkably sensitive to temperature, pressure and flow conditions, which can cause problems if variations are encountered as the beer is delivered. Organic deposits can form in the conduits, causing discontinuities affecting fluid flow conditions. For example, a deposit can produce a flow restriction such that the beer encounters a pressure drop when flowing past the restriction. Pressure changes encountered by the beer may cause unacceptable foaming, and may adversely affect the taste and aroma of the beer. In addition, inasmuch as the deposits are organic, they can lead to unsanitary conditions in the conduit. For these and other reasons, it is important to clean the conduits periodically to remove any deposits.

One method for cleaning conduits is to flush them with a cleaning solution and water. An example of an apparatus for flushing conduits is disclosed in U.S. Pat. No. 4,527,585—Mirabile, the disclosure of which is hereby incorporated in its entirety. Mirabile discloses an automatic flushing system which is permanently installed and integral with the beverage delivery system. The beverage containers or kegs are decoupled from the conduits and isolated automatically by valves that instead couple the conduits to sources of water and cleaning fluid. The conduits are sequentially flushed with a hot water cleaning solution and cold water. Although efficient and automated, the Mirabile device requires a permanent plumbing installation in the refrigerated room or other storage area of the beverage delivery system, for coupling to the connecting lines to the beverage containers. The permanent installation is expensive in that plumbed hot and cold water connections and a drain are required. The unit permanently occupies valuable storage space in the beverage container storage area.

U.S. Pat. No. 5,090,440—Ladouceur et. al. discloses another device for flushing beverage delivery system conduits. Ladouceur has a fluid manifold and multi-input, pressure responsive tap valves. The fluid manifold distributes water from a central water source to each of the multi-input tap valves, which valves are also coupled to a pressurized source of beverage. In order to clean the beverage conduit lines, the spigots in the customer area are opened and the central water source is activated, causing water under pressure to flow through the manifold to the multi-input valves. The pressure of the water operates the valves to shut off the beverage flow paths and allow water to flow through the beverage conduits to exit at the spigots.

A problem with the Ladouceur multi-input valve system is that it relies on having a water pressure greater than the delivery pressure of the beer, as the means to operate the valves for switching between flows of water and beer. If the water pressure is insufficient in comparison to the beer delivery pressure, then beer and water can mix during the flushing process. Such mixing can occur, for example, if the water inlet valve is not opened fully, if the water pressure drops during the flushing process, etc. If the pressure differentials vary back and forth around the switching point of the valves during flushing, a substantial quantity of beverage can be mixed with the water, flushed away and wasted. In addition, by using only water flushing, Ladouceur does not provide an automated means for applying a sanitizing agent such as a detergent.

Thus it would be advantageous to provide a beverage conduit cleaning device that accurately and automatically switches and meters flows of water and cleaning solution, and that is embodied in an efficient portable unit that is easily coupled to clean and flush beverage conduits.

SUMMARY OF THE INVENTION

It is an object of the invention to provide a conduit cleaning apparatus which manages flows of liquid detergent and pressurized water using a computerized controller.

It is a further object to provide a conduit cleaning apparatus which is conveniently coupleable immediately to the keg connections of conventional beverage delivery systems, i.e., to the lines normally connected to a keg.

It is a further object to provide a conduit cleaning apparatus which is self contained, portable and easily deployed.

These and other objects are accomplished by a portable conduit cleaning apparatus for a beverage delivery system of the type having at least one conduit for carrying beverage from a pressurized beverage source to an output. The conduit cleaning apparatus is carried in a self-contained portable cart. The cart has wheels, support legs and handles for conveniently locating the cart for connection to the beverage conduit. The cart is coupled to the beverage conduit, to a source of water and to a source of electric power. The cart contains a manifold in which detergent and pressurized water are controllably mixed. In particular, liquid detergent is supplied to the manifold by a detergent feed line with a first solenoid valve. Water from an outside source passes a flow regulator and is applied under pressure to the manifold through a water feed line with a second solenoid valve. Mixed water and liquid detergent flow through a flush line connected to the beverage conduit, having a third solenoid valve. The solenoid valves are operated and coordinated to effect mixing and flushing operations by a computerized controller in the cart.

Other objects, aspects and advantages of the invention will become apparent from the following description of a practical embodiment of the invention as depicted in the accompanying drawings.

BRIEF DESCRIPTION OF THE DRAWINGS

There are shown in the drawings certain embodiments of the invention as presently preferred; it being understood, however, that the invention is not limited to the precise arrangements and instrumentalities shown.

DETAILED DESCRIPTION OF THE PREFERRED EMBODIMENTS

Figure 1:
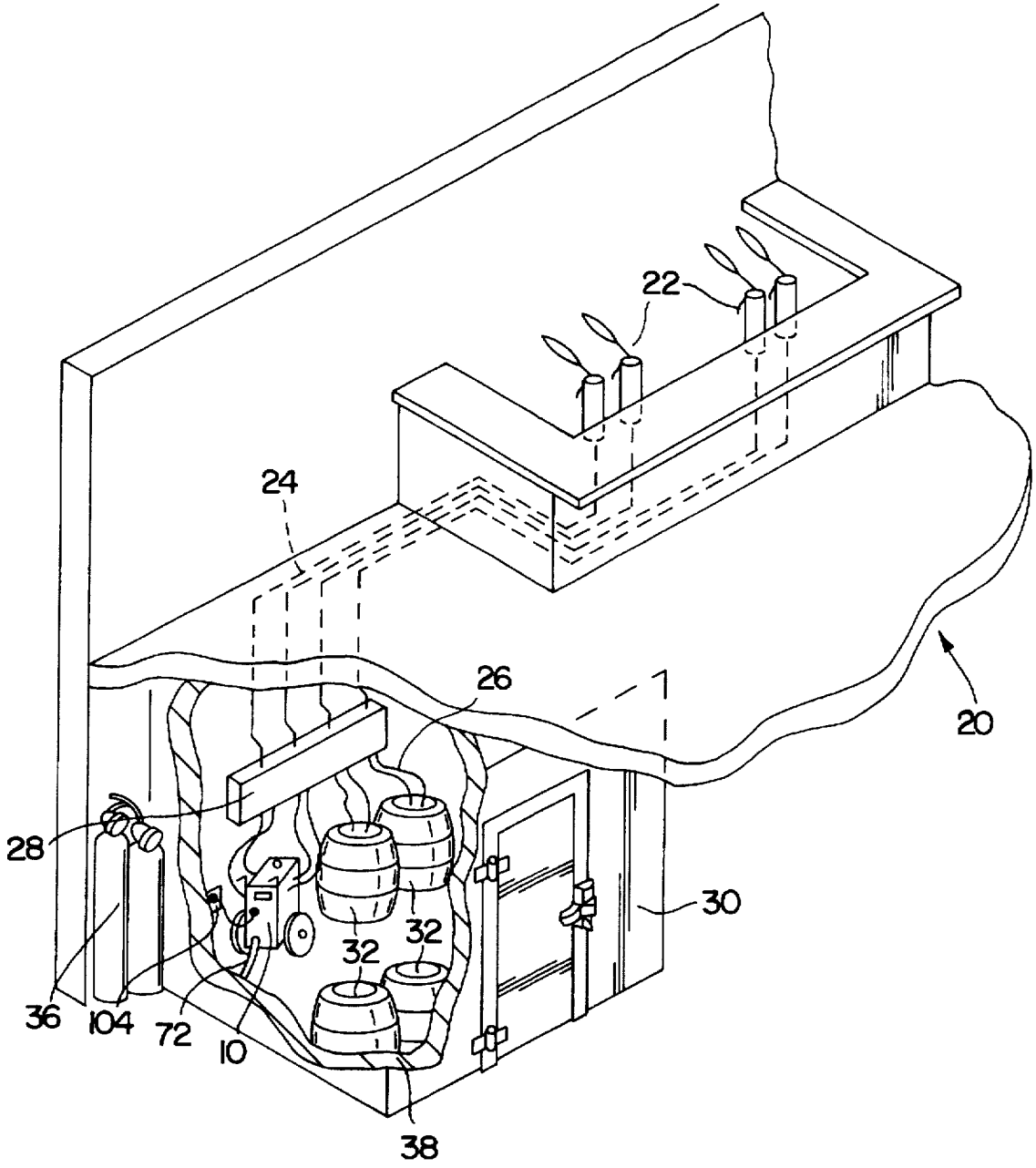
FIG. 1 is a perspective cutaway view of a two-story tavern and keg storage arrangement, the beverage conduits being connected to the portable conduit cleaner of the present invention.

Referring to FIGS. 1–4, in which the same reference numbers have been used throughout to indicate the same elements, the invention in its overall environment is shown in FIG. 1. In order to convey a cold beverage such as draft beer to a distribution point, a cold storage area in which supplies of the beverage are stored is connected via permanently installed beverage conduits 24 to the beverage distribution points. A walk-in refrigerator 30, namely a thermally insulated room of relatively substantial size, is located remotely from the serving area or tavern 20, for example in the basement of the building. The beverage containers 32 are pressurized for moving the beverage through the conduits and for maintaining gas in solution, for example by a compressed gas supply 36, typically containing $CO_2$. Under pressure, the liquid beverage carried by lead beverage tube 26 and conduits 24 from kegs 32 is dispensed into glasses, pitchers and the like at distribution spigots 22, by opening the spigots when needed. A flow rate of approximately one gallon per minute per conduit 24 is considered to be adequate for most installations.

Tavern operators may desire to cool and store some sealed kegs 32 in the walk-in refrigerator 30 that is used to store the kegs 32 that are coupled to the beverage delivery system, and also to use refrigerator 30 to store and cool other materials. Food may be stored in refrigerator 30, or even if the establishment operates solely as a beverage supplier, package beverages may be stored in the same refrigerator. These additional storage needs restrict the available space for kegs 32.

Efficiency of cooling requires that the internal dimensions of walk-in refrigerator 30 be as small as practicable for storing an adequate supply of kegs 32, together with such other materials as may be stored. Regarding the beverage delivery system, an in-line refrigeration unit 28 can be utilized to supplement cooling by cooling the conduits through which the beverage passes. The in-line refrigeration unit 28 can also be located in the walk-in refrigerator 30, which further constricts available storage space. In addition, insulation 38, which slows the passage of heat through the walls, requires a certain wall thickness that also constricts the available storage space within the walk-in refrigerator 30.

As shown in FIG. 1, it is an aspect of the invention that a portable conduit cleaning apparatus 10 is provided. It is only necessary to place apparatus 10 in walk-in refrigerator 30 during actual cleaning of conduits 24. After the cleaning/flushing operations are completed, conduit cleaning apparatus 10 can be removed to free space for storage.

Figure 2:
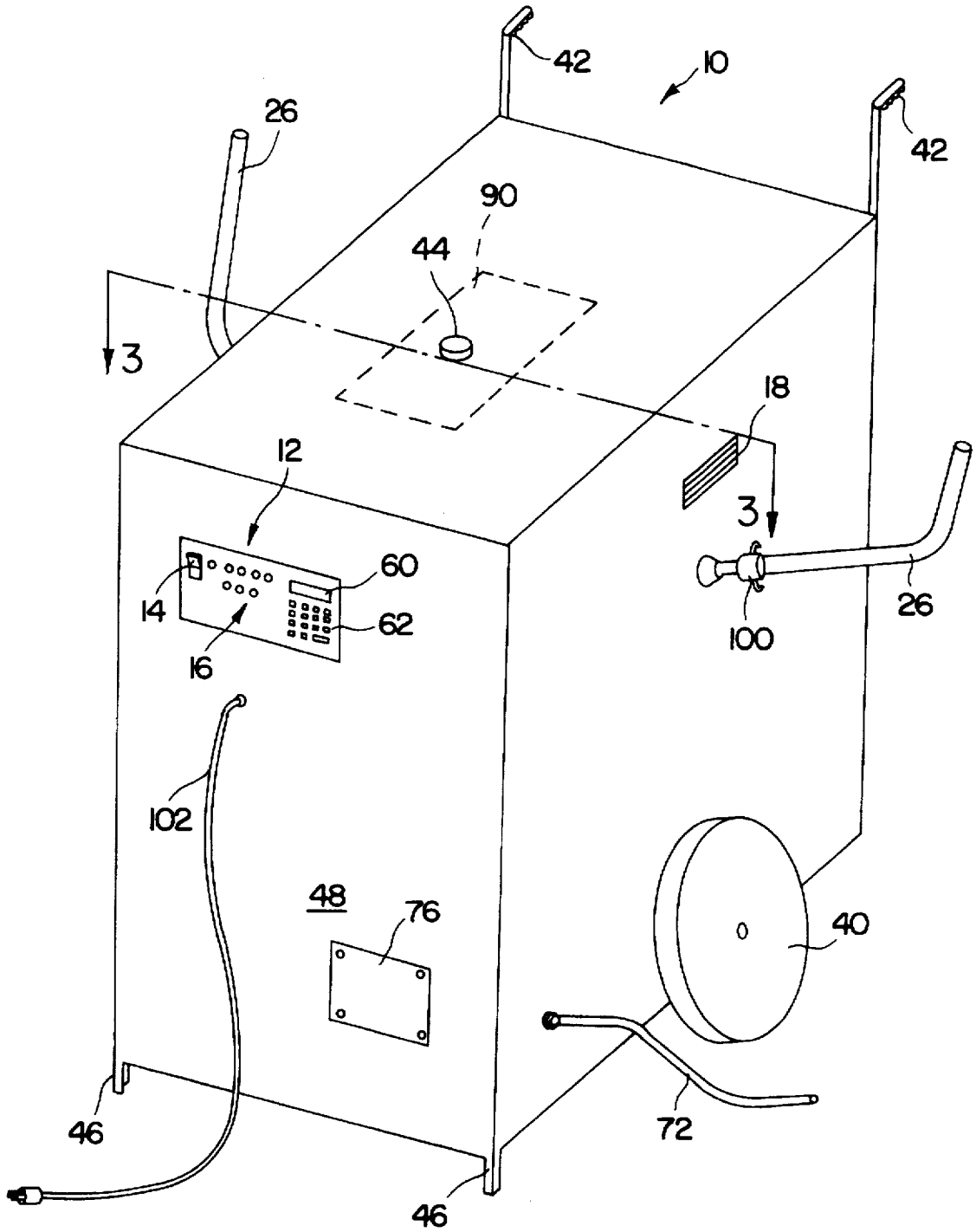
FIG. 2 is a perspective view of the portable conduit cleaner of the invention.

The conduit cleaning apparatus 10 is self contained in a mobile cart 48. As shown in FIG. 2, cart 48 is electrically powered via a power cord 102, and has a front control panel 12, and an access panel 76. A reservoir 90 for liquid detergent is accessible via a top panel screw cap 44 in order to fill reservoir 90, shown if phantom. Air vents 18 are located on the sides of cart 48, as are fittings 100 which are shown connected to the lead beverage tubes 26 of beverage conduits 24. The lead beverage tubes 26 are short flexible connecting lines that normally are used to couple a keg 32 to the permanent conduits 24, but for cleaning operations are used to couple apparatus 10 to conduits 24.

Cart 48 is carried on wheels 40, preferably a set of two that together with support legs 46 and handles 42 allow apparatus 10 to be wheeled about in the manner of a handcart. To move apparatus 10, the user lifts support legs 46 off the ground by exerting downward pressure on handles 42 to rotate cart 48 slightly around the axis of wheels 40, whereupon the user is free to wheel the cart 48 to a desired position for coupling to conduits 24 or to remove it from the walk-in refrigerator 30 to clear space.

Figure 3:
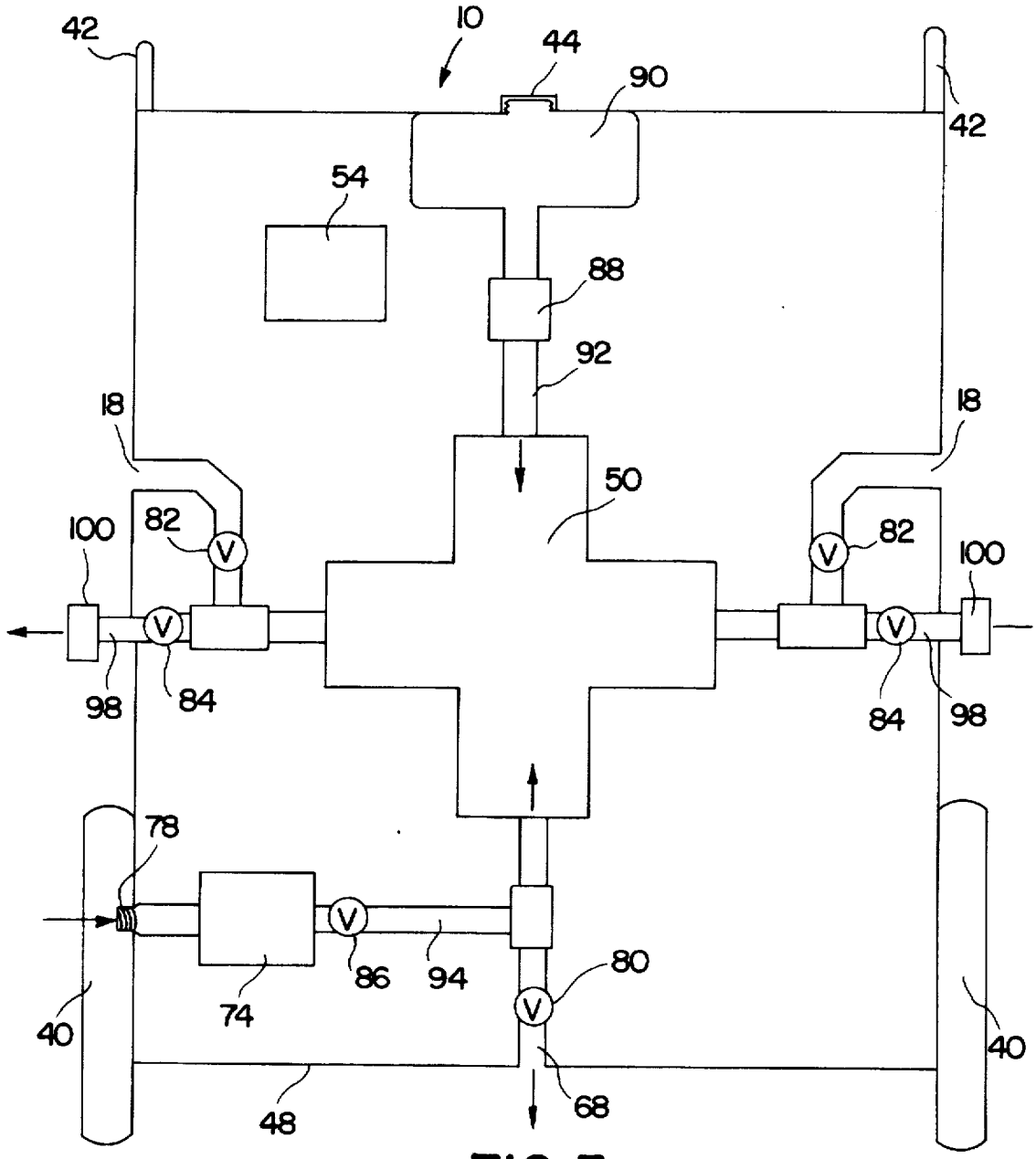
FIG. 3 is a view, taken along line 3—3 of FIG. 2, showing further details of the conduit cleaner of the invention.

Cart 48 houses automated means for flushing beverage conduits 24, as described in greater detail with reference to FIG. 3. A central manifold 50 in cart 48 receives and mixes liquid detergent and pressurized water. Liquid detergent is supplied to reservoir 90 by removing screw cap 44, located at the top of cart 48 and pouring liquid detergent into reservoir 90, which can store a quantity sufficient for a number of cleaning/flushing cycles. Water is supplied to the conduit cleaning apparatus 10 from an external water supply, such as a municipal water supply. A hot water supply can be utilized or a cold water supply can be used, optionally run through an in-line heater (not shown) before entering apparatus 10. For example as shown in FIG. 1, a standard garden hose 72 can be coupled between the external supply to the conduit cleaning apparatus 10 for supply of inlet water. Threaded connection 78 is provided which mates with garden hose 72 and can be used with other interface attachments such as a quick connect hose coupler.

Via threaded connection 78, hose 72 supplies water to water regulator 74 which can comprise a pump and/or a flow restrictor for regulating the water to achieve a flow at the required pressure and/or flow rate for a particular installation. For example, water regulator 74 can be adjustable to provide desired pressure levels for the water. In order to adjust the pressure level, access panel 76, shown in FIG. 2, is removed to expose the adjustable screws (not shown) for controlling the diameter of a flow restriction. A reduction in diameter decreases the rate of flow of water and increases the pressure drop across the regulator, and an increase in diameter increases the flow rate and decreases the pressure drop. After flowing through water regulator 74, the water enters water feed line 94, which connects the water regulator 74 to manifold 50. As shown in FIG. 3, water from the water feed line 94 may be isolated from manifold 50 by a first solenoid valve 86 which is disposed within water feed line 94 and is electrically controllable for coupling and decoupling water feed line 94 from manifold 50.

Detergent feed line 92 connects manifold 50 to reservoir 90. A second electrically controllable solenoid valve 88 is provided along liquid detergent feed line 92. When valve 88 is opened, the flow of liquid detergent into manifold 50 is gravity driven at a substantially constant flow rate. This allows the quantity of detergent charged into manifold 50 to be metered, by controlling the period of time solenoid valve 88 is kept open. For example, in order to sanitize larger beverage conduits, more liquid detergent is typically required and valve 88 can be kept open for a longer period of time. Valve 88 can comprise a check valve, to isolate reservoir 90 by only permitting flow in a downstream direction, i.e., towards manifold 50. This isolating function is important for certain types of detergent, which after being mixed with water lose their sanitizing potency in a short time, e.g., approximately ten minutes.

After the pressurized water and liquid detergent have been mixed in the manifold 50, the solution is flushed through the beverage conduits 24 via at least one flush line 98 which includes a third electrically controllable solenoid valve 84. As will be discussed in greater detail below, valve 84 is closed during the mixing of water and detergent in manifold 50. As the manifold 50 fills, the pressure of the water and detergent mixture increase. Once the mixing cycle is complete the valve 84 is opened and the beverage conduits are flushed with the high pressure water and detergent mixture, driven by the regulated inlet water pressure.

In order to connect the flush line 98 to beverage conduit 24, fitting 100 is attached to the downstream end of flush line 98. Beverage conduits 24 are normally connected to kegs 32 via a lead beverage tube 26 which includes a standard tri-prong connection for tapping kegs 32. In order to allow for quick connection to apparatus 10, fittings 100 mate with the tri-prong connection of the lead beverage tube 26, permitting the cleaning apparatus 10 to be coupled into the beverage delivery system in a manner similar to coupling a keg 32.

The mixing and flushing operations are followed by evacuation of manifold 50 through drain 68 which empties manifold 50 by gravity. In the event that valve 84 remains open and the spigot at the dispensing end is open, drain 68 can also be used to gravity drain the conduit after flushing. Drain 68 is opened and closed by a fourth electrically controllable solenoid valve 80 in series with drain 68. After evacuation of the manifold 50, the drain valve 80 is closed, a cycle of mixing of liquid detergent and water can commence. One way solenoid valve 88 opens to allow liquid detergent to flow into manifold 50. To facilitate free flow of liquid detergent into manifold 50, an air vent 18 can be opened via a fifth controllable solenoid valve 82 in communication with manifold 50. Valve 82 is opened at the same time as valve 88, before opening water inlet valve 86, allowing air in manifold 50 to escape as detergent enters. Venting air trapped within manifold 50 assists in achieving a constant flow rate and enables the controller for the system to meter precisely the amount of detergent which enters manifold 50. When a predetermined quantity of detergent has flowed into manifold 50, vent 18 is closed and mixing begins.

Figure 4:
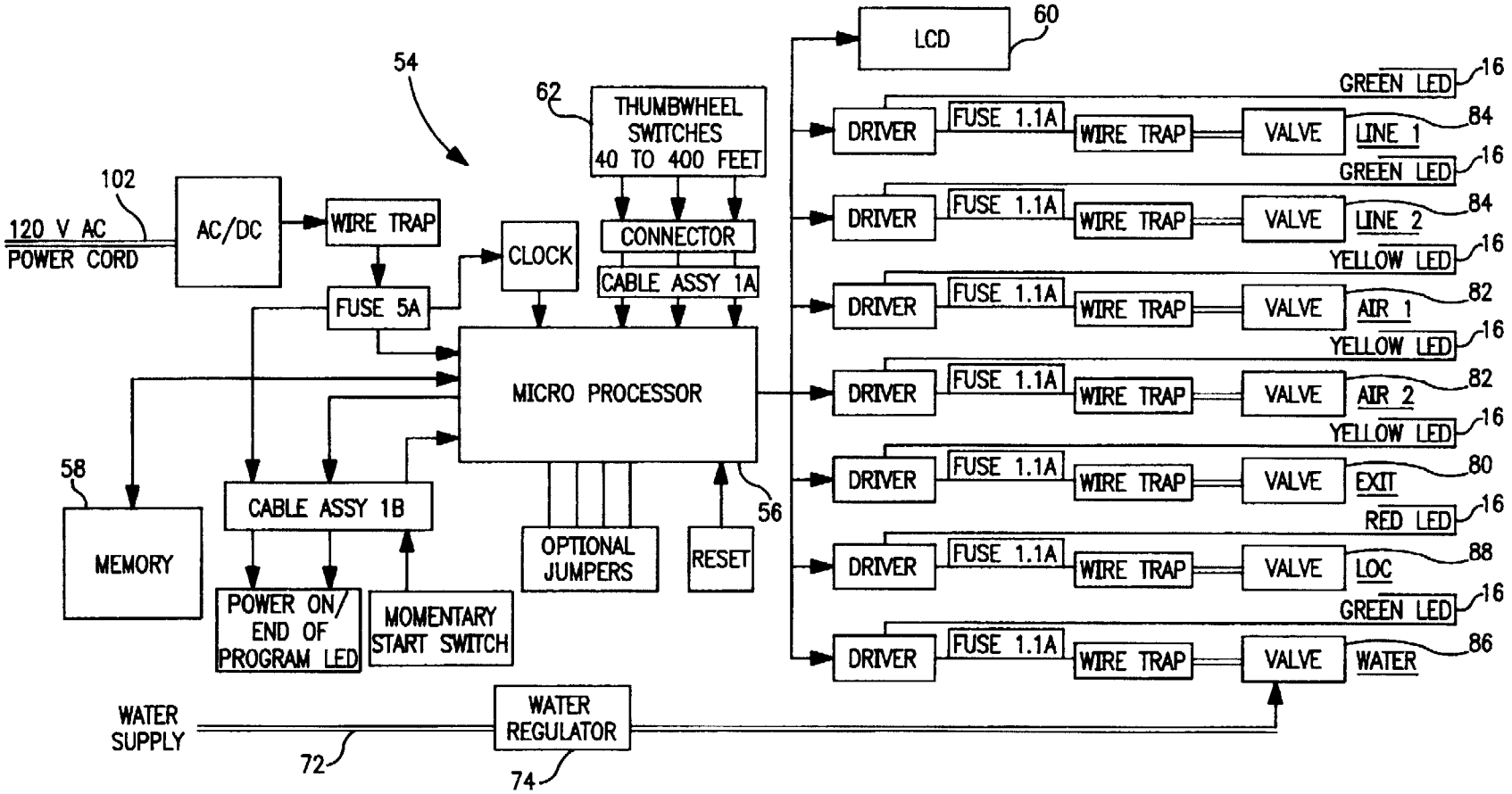
FIG. 4 is a schematic diagram showing a computerized controller for the portable conduit cleaner according to the invention.

The respective charging, venting, mixing, flushing and draining operations of apparatus 10 are accomplished by the sequenced operation of solenoid valves 80, 82, 84, 86, and 88 under control of a programmed computerized controller 54. FIG. 4 is a block diagram showing input/output and control particulars of controller 54, comprising a microprocessor 56 coupled to a main memory 58, which communicate over a system bus.

Controller 54 can execute a fixed sequence routine which is stored in a nonvolatile part of main memory 58 by the manufacturer. In that embodiment, main memory 58 comprises an electrically erasable programmable read only memory (EEPROM). The quantity of detergent and the length of the respective mixing and flushing cycles can be fixed in the memory, and/or made at least partly variable by user inputs.

Preferably, main memory 58 comprises both random access memory (RAM) and nonvolatile ROM. The RAM allows the user to program and store variations in the sequence routine otherwise stored in ROM, such as the length of time beverage conduit 24 is to be flushed, whether to accomplish plural cleaning/flushing cycles and other programmable variations. The user alters the sequence routine by using an alpha-numeric key pad 62 in conjunction with data displayed on a readout such as LCD 60, located on control panel 12. The user is prompted by a message displayed on the LCD 60, for example to input the time that beverage conduit 24 to be cleaned. In response to the user input and in accordance with programming information and data stored in ROM, microprocessor 56 calculates and executes the sequence according to the selected amount of liquid detergent, time during which beverage conduit 24 should be flushed and the like. From this information controller 54 determines the times at which each of solenoid valves 80, 82, 84, 86 and 88 are opened.

In addition to signals for triggering the solenoid valves or drivers for the valves, preferably, controller 54 also outputs status information. As the sequencing routine operates, controller 54 displays which valve(s) are open by lighting LED's 16 associated with the valves, which are located on control panel 12, or suitably controlling the display on LCD 60.

In operation, portable conduit cleaning apparatus 10 is wheeled into walk-in refrigerator 30 and placed in proximity to a lead beverage tube 26. Lead beverage tube 26 is disconnected from its beverage container 32, if necessary, and the associated spigot 22 for the conduit is opened at the customer area. More than one conduit is preferably cleanable at one time. The ends of lead beverage tubes 26 are attached to respective fittings 100. The power cord 102 is plugged into a 120 VAC electrical outlet and apparatus 10 is then turned on by operation of power switch 14.

When the power is turned on, solenoid valves 80, 82, 84, 86 and 88 are held closed until a cycle is initiated by user input. Apparatus 10 is connected to an external water supply by connecting one end of a hose such as a standard garden hose 72 to the external water supply and the other end to threaded connection 78. When the external water supply is activated, no water flows initially into manifold 50 because solenoid valve 86 is closed.

Liquid detergent is added to reservoir 90 by removing screw cap 44 on the top of cart 48, allowing for the detergent to be poured into reservoir 90. Apparatus 10 is then ready for operation. If the sequence routine is fixed, then LCD 60 displays a prompt message asking the user to press an "enter" button or the like, located on the alpha-numeric key pad 62, to commence operation. If the sequence routine is alterable either by user inputs or by information storable in a portion of main memory 58 of controller 54 including RAM, then LCD 60 displays prompt messages enabling the user to execute a stored sequence routine or to alter the routine. After selecting operational particulars, LCD 60 displays a prompt message asking the user to press "enter" to commence.

Preferably, the controller determines at least some of the operational parameters of the sequence by calculations. For example, the user can be prompted to enter information respecting the particular conduit to be flushed, such as its length. After the length of the conduit is input, and as a function of sensed or assumed water pressure and flow conditions, controller 54 makes the necessary calculations to determine the length of time that solenoid valves 82, 84, 86, and 88 will be kept open in order to ensure an adequate quantity of detergent and adequate flushing time to expose the entire conduit to the cleaning solution, to flush the conduit afterwards, and preferably to drain the conduit of flush water. These calculations can be accomplished in a very short time, whereupon the user is prompted to press the "enter" button to commence operation. The user also can have the option to review and potentially to adjust the particulars of the cycle as calculated by the controller, before commencing operation.

Upon commencement of operation, solenoid valve 82 is operated to open air vent 18. Drain 68 is opened by solenoid valve 80 to evacuate manifold 50 and valve 80 is then closed to close drain 68. Solenoid check valve 88 is then operated to allow liquid detergent to flow into and charge manifold 50. The amount of detergent which flows into the manifold 50 is dependent upon the amount of time valve 88 is opened, which can be variable under processor and/or user control. Once manifold 50 is charged, solenoid valves 82 and 88 close liquid detergent feed line 92 and air vent 18. Solenoid valve 86 is opened, allowing pressurized water from water feed line 94 into manifold 50 where it mixes with the detergent to provide the cleaning solution. Flush line 98 is then opened by solenoid valve 84. The pressurized water and detergent mixture flow through lead beverage tube 26 into beverage conduit 24 toward spigot 22 at the opposite end, thus flushing and sanitizing beverage conduit 24.

The flushing continues after the bolus of water/detergent solution is discharged from spigot 22. After the water/detergent solution is forced from manifold 50 by incoming water, no liquid detergent remains in manifold 50 to mix with the incoming pressurized water. Thus, keeping the water inlet valve 86 and outlet valve 84 open to flush line 98 for a pro-longed period, effectively rinses all the detergent from beverage conduit 24. When rinsing is complete, solenoid valve 86 is operated to shut off the water inlet. Outlet valve 84 can be shut off at the same time or left open for a time while drain valve 80 is held open for draining the conduit through line 98. After conduit 24 is substantially drained, valve 84 can be closed. Air vent 82 is re-opened by solenoid valve 82, such that any remaining contents of manifold 50 are drained away through drain 68. Valves 80 and 82 are then closed.

The present invention may be embodied in other specific forms without departing from the spirit or essential attributes thereof and, accordingly, the described embodiments are to be considered in all respects as being illustrative and not restrictive, with the scope of the invention being indicated by the appended claims, rather than the foregoing detailed description, as indicating the scope of the invention as well as all modifications which may fall within a range of equivalency which are also intended to be embraced therein.

I claim:

1. A portable cleaning apparatus for beverage delivery systems of the type having at least one conduit for carrying a beverage in a delivery direction from a pressurized beverage source to an output, the apparatus comprising:

a manifold in which liquid detergent and pressurized water are combined to form a sanitizing solution, said sanitizing solution being discharged into said at least one conduit for carrying a beverage;

a water feed line for providing pressurized water to said manifold, said water feed line having a first controllably operable valve disposed therein;

a liquid detergent feed line for transferring liquid detergent from a reservoir to said manifold, said liquid detergent feed line having a second controllably operable valve disposed therein;

at least one flush line for receiving said sanitizing solution and delivering said solution to said at least one conduit, said flush line having a third controllably closable valve disposed therein;

at least one air vent for bleeding off air within said manifold, the air vent having a fourth controllably closable valve disposed therein, said fourth valve being open when liquid detergent is charged into said manifold thus allowing for accurate flow of the liquid detergent into said manifold;

a controller operatively connected to the first, second, third and fourth valves for selective operation to open and close said feed and flush lines, the controller executing a procedure which opens the first, second, third and fourth valves in a selective sequencing manner in order to communicate said sanitizing solution and flush said conduit for carrying a beverage; and, a mobile cart carrying the manifold, the controller and the first through fourth valves, whereby the apparatus is removably connected to the beverage delivery system in place of the beverage source when flushing of the beverage delivery system is required.

2. The portable cleaning apparatus of claim 1, wherein the mobile cart comprises wheels, and a handle allowing the cart to be moved manually for temporary connection to the beverage delivery system.

3. The portable cleaning apparatus of claim 2, further comprising a drain for emptying said manifold after said conduit has been cleaned, said drain having a fifth controllably closable valve disposed therein, the operation of said fifth controllably closable valve being sequentially controlled by said controller.

4. The portable cleaning apparatus of claim 1, wherein said controller comprises a computer with a memory at least partly including a read only memory in which said procedure for sequentially opening said first, second, third and fourth valves is stored.

5. The portable cleaning apparatus of claim 1, wherein said controller comprises a computer with a memory at least partly including a random access memory in which said procedure for sequentially opening said first, second, third and fourth valves is stored, at least partly by operation of the computer.

6. The portable cleaning apparatus of claim 1, further comprising at least one lead beverage tube having its distal end connected to said conduit and its proximal end connected to said pressurized beverage source, the apparatus further comprising means for attaching the proximal end of said lead beverage tube to the flush line, said means being located on the outside of said cart.

7. The portable apparatus of claim 6, wherein said means for attaching the proximal end of the lead beverage tube to said flush line comprises a standardized keg fitting adapted to receive the lead beverage tube.

8. The portable apparatus of claim 1, wherein said water feed line is supplied pressurized water from a flow regulator which is located within said cart and connected to an external water source.

9. A portable cleaning apparatus for beverage delivery systems of the type having at least one conduit for carrying a beverage in a delivery direction from a pressurized beverage source to an output, the apparatus comprising:

a mobile cart carried on at least two wheels;

a manifold in said cart for receiving and mixing liquid detergent and pressurized water;

a water feed line connecting the manifold to a water regulator which receives and regulates water from a source external to said cart;

a first valve along the water feed line, operable to open and close flow of pressurized water to the manifold;

a detergent feed line connecting the manifold to a detergent reservoir in the cart;

a second valve along the detergent feed line, operable to permit a flow of detergent to the manifold but preventing backflow from the manifold to the reservoir;

at least one flush line connecting the manifold to said at least one conduit;

a third valve along said at least one flush line, for opening and closing flow of a solution of detergent and water from the manifold to the conduit;

a fourth valve disposed between the manifold and a vent, said fourth valve being opened when liquid detergent is to be charged into said manifold thus allowing for accurate flow of the liquid detergent into said manifold; and a controller operatively connected to selectively operate the first, second, third and fourth valves, said controller executing a procedure which opens and closes said valves in a sequence of operations in order to mix the pressurized water and detergent, allow the solution of pressurized water and detergent to flow into said conduit for carrying a beverage and thereafter rinse the conduit for a predetermined time.

10. The portable cleaning apparatus of claim 9, further comprising a drain connected to said manifold, said drain having a fifth valve operable by the controller as a drain valve permitting the manifold to drain after the predetermined time.

11. The portable cleaning apparatus of claim 9, wherein said controller comprises a computer having a memory at least partly including programmable read only memory storing said procedure.

12. The portable cleaning apparatus of claim 9, wherein said controller is a computer having a memory at least partly including a random access memory, the controller accepting data from user inputs for varying and storing parameters defining the procedure.

13. The portable cleaning apparatus of claim 9, further comprising at least one lead beverage tube having its distal end connected to said conduit and its proximal end connected to said pressurized beverage source, the apparatus further comprising means for attaching the proximal end of said lead beverage tube to the flush line in lieu of the beverage source.

14. The portable apparatus of claim 13, wherein said means for attaching the proximal end of the lead beverage tube to said flush line comprises a standardized keg fitting adapted to receive the lead beverage tube.

15. The portable apparatus of claim 9, further comprising a water regulator along said water feed line for regulating at least one of a pressure and flow rate of water.

* * * * *